US009574463B2

(12) United States Patent
Manther et al.

(10) Patent No.: US 9,574,463 B2
(45) Date of Patent: Feb. 21, 2017

(54) SWITCHABLE FINGER FOLLOWER WITH LOST MOTION SPRING LOST STROKE MINIMIZER

(71) Applicant: Schaeffler Technologies AG & Co. KG, Herzogenaurach (DE)

(72) Inventors: Debora Manther, Royal Oak, MI (US); Allen Hale, Commerce Township, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 125 days.

(21) Appl. No.: 14/691,927

(22) Filed: Apr. 21, 2015

(65) Prior Publication Data

US 2016/0312666 A1 Oct. 27, 2016

(51) Int. Cl.
*F01L 1/18* (2006.01)
*F01L 1/24* (2006.01)

(52) U.S. Cl.
CPC ..... *F01L 1/24* (2013.01); *F01L 1/181* (2013.01); *F01L 1/18* (2013.01); *F01L 2001/2444* (2013.01)

(58) Field of Classification Search
CPC ..... F01L 1/18; F01L 1/24; F01L 1/181; F01L 2001/2444
USPC ..... 123/90.39, 90.44
See application file for complete search history.

(56) References Cited

U.S. PATENT DOCUMENTS 7,174,869 B2 2/2007 Proschko et al.
7,661,400 B2 * 2/2010 Seitz ..... F01L 1/185 123/90.39

* cited by examiner

*Primary Examiner* — Ching Chang
(74) *Attorney, Agent, or Firm* — Volpe and Koenig, P.C.

(57) ABSTRACT

A switchable finger follower having at least two lift modes includes a primary lever and a secondary lever mounted for pivoting movement to the primary lever, the secondary lever includes a cam contact surface, and a lost motion contact projection. A coupling device on the primary lever includes a coupling pin that moves between a locking position, in which the secondary lever is locked to the primary lever in a lift position, and an unlocked position, in which the secondary lever is pivotable relative to the primary lever. A first lost motion idler arm is pivotally connected to the primary lever and has a distal end that contacts the lost motion contact projection. A first lost motion spring is located between the primary lever and the first lost motion idler arm that maintains a preload on the secondary lever via the first lost motion idler arm in the unlocked position.

17 Claims, 4 Drawing Sheets

SWITCHABLE FINGER FOLLOWER WITH LOST MOTION SPRING LOST STROKE MINIMIZER

FIELD OF INVENTION

The invention relates to roller finger followers that are used in overhead cam-type internal combustion engines and, more particularly, to switchable roller finger followers that have a high lift and a low or no lift mode.

BACKGROUND

Switchable roller finger followers are known. See, for example, U.S. Pat. No. 7,174,869. Such finger followers have a secondary lever in the form of an outer lever pivotably mounted outside a primary lever in the form of an inner lever and a roller rotatably mounted on a transverse axle in a slot in the inner lever. The top surface of the outer lever can act as a contact surface for a high lift cam and the top surface of the roller acts as a contact surface for a low lift cam. A coupling element is mounted at one end of the finger follower and oil from an oil source is used to activate the coupling element. When the coupling element is activated, it locks the outer lever to the primary or in this case inner lever and requires the follower to follow the high lift cam and transfer the lift to the valve stem of an associated intake or exhaust valve. When the coupling element is deactivated, the secondary or in this case outer lever is free to pivot relative to the inner lever and, under the aid of a lost motion spring, the outer lever pivots freely in conjunction with the high lift cam while the motion of the low lift cam is transferred by the inner lever to the valve stem. This movement by the outer lever is conventionally referred to as the lost motion stroke.

Alternatively, the switchable finger follower can have a lift mode and a no lift mode. In this case, the secondary lever in the form of an inner lever is pivotably mounted within a primary or in this case outer lever, and a roller is rotatably mounted on a transverse axle in a slot in the inner lever. In the lift mode, a coupling device locks the secondary or in this case inner lever to the primary, outer lever so that the cam movement is transferred from the roller to the inner lever/outer lever which act as one piece and transfer the lift to a valve stem. In the no lift mode, the secondary or in this case inner lever is unlocked from the primary, outer lever and, under the aid of the lost motion spring, the secondary, inner lever is free to pivot relative to the primary, outer lever so that no lift is transferred.

In either case, the lost motion spring is used to absorb motion of the secondary lever relative to the primary lever to maintain contact between the cam follower of the secondary lever and the cam during the lost motion stroke. The size of the lost motion stroke available is often limited by the space available about the roller axle, as well as the angular displacement of the lost motion spring acting between the primary lever and the secondary lever. Additionally, the ends of the lost motion springs that contact the lost motion part require a high pre-load in order to prevent pumping up of the hydraulic lash adjuster support assembly out of its support opening in the block or head due to the oil pressure exceeding the downward spring pressure.

It would be desirable to provide a finger follower of the type noted above that would allow for lower preloads of the lost motion spring as well as smaller angular displacements, while still allowing the same or even greater lost motion travel between the inner and outer levers.

SUMMARY

Briefly stated, a switchable finger follower having at least two lift modes for a valve train of an internal combustion engine is provided. The switchable finger follower includes a primary lever having first and second ends, with a valve stem support located at the first end and a lash adjuster support recess located at the second end. A secondary lever is mounted for pivoting movement at the first end of the primary lever by a pivot axle. The secondary lever includes: a coupling surface facing the second end, a cam contact surface, and a first lost motion contact projection. A coupling device is located on the primary lever that includes a coupling pin arranged to move in a longitudinal direction between a locking position, in which the secondary lever is locked to the primary lever in a lift position at least in an activation direction of a valve, and an unlocked position, in which the secondary lever is pivotable relative to the primary lever. The coupling pin includes a contact surface for engagement with the coupling surface of the secondary lever in the locking position. A first lost motion idler arm is pivotally connected to the primary lever at a pivot end of the first lost motion idler arm and has a distal end that contacts the lost motion contact projection on the secondary lever. A first lost motion spring is located between the primary lever and the first lost motion idler arm that maintains a preload on the secondary lever via the first lost motion idler arm in the unlocked position.

In one embodiment, the primary lever is an outer lever and is formed with receiving space therein for receiving the secondary lever in the form of an inner lever. It is also possible in other embodiments for the inner lever to be the primary lever and the outer lever to be the secondary lever, for example, for a low lift-high lift mode.

In one embodiment, the cam contact surface on the secondary lever is provided by a roller mounted with a transverse axle in a slot defined in the inner lever.

In one embodiment, the outer lever comprises two outer arms with the receiving space defined therebetween.

In one embodiment, the first lost motion spring is formed as a leg spring having a first leg that contacts the first lost motion idler arm and a second leg that is engaged on a portion of the primary lever.

In one embodiment, the first lost motion projection has a curved contact face that contacts the first lost motion idler arm.

In a preferred aspect, a spring contact surface of the first lost motion idler arm is located in proximity to a pivot connection to the primary lever. The spring contact surface of the first lost motion idler arm may have a convex profile.

In one embodiment, in the unlocked position, a contact point of the first lost motion idler arm against the first lost motion remains approximately constant during a cam lift.

In one embodiment, a second lost motion projection is provided on the secondary lever, and a second lost motion idler arm is pivotally mounted to the primary lever. A second lost motion spring is provided that maintains an additional preload on the secondary lever via the second lost motion idler arm in the unlocked position In one embodiment, a spring force of the first and second lost motion springs is less than a force generated by a valve spring acted on by the finger follower.

In one embodiment, the coupling device comprises a coupling housing located on the primary lever with a coupling pin bore in which the coupling pin is located. Preferably, a hydraulic fluid passage is located in the primary lever and extends to a pressure space in the coupling pin bore, and pressurized hydraulic fluid provided to the pressure space moves the coupling pin to the unlocked position.

In a preferred aspect of the invention, the coupling pin includes a flat that defines the coupling pin contact surface, and an orientation of the coupling pin is maintained by the idler arm pin being positioned across the coupling pin contact surface to act as an anti-rotation guide.

In one embodiment, at least one contact surface between the first lost motion idler arm and the first lost motion contact projection is coated with a friction reducing coating.

In another aspect, a valve train having switchable finger followers with one or more of the above features is provided for activation of gas exchange valves of an internal combustion engine.

Using one or more of these features results in a switchable finger follower with additional functionality.

Other aspects of the invention are described below and in the claims, and have not been repeated here.

BRIEF DESCRIPTION OF THE DRAWINGS

The foregoing Summary and the following detailed description will be better understood when read in conjunction with the appended drawings, which illustrate a preferred embodiment of the invention. In the drawings.

DETAILED DESCRIPTION OF THE PREFERRED EMBODIMENTS

Figure 1:
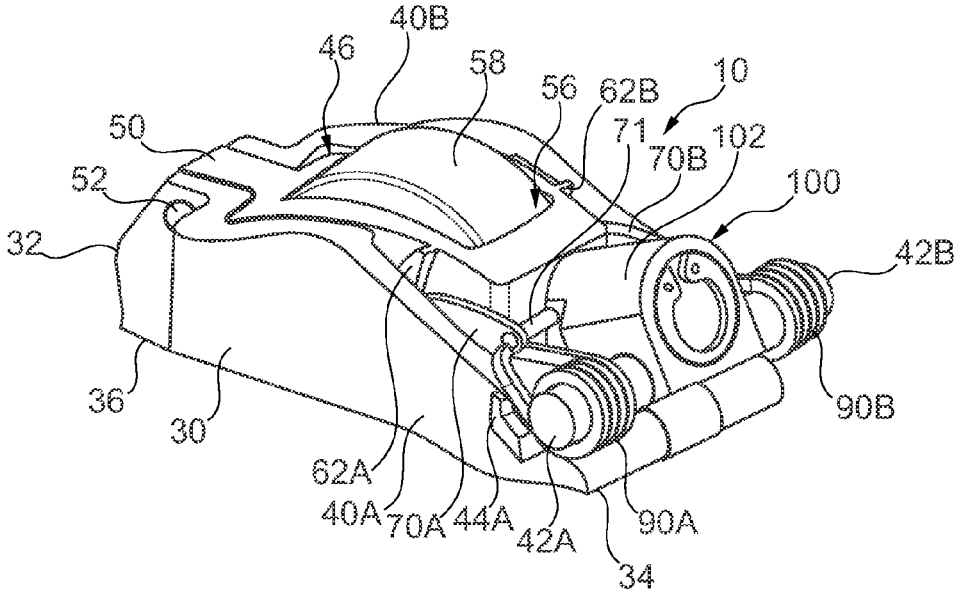
FIG. 1 is a perspective view of an embodiment of a switchable finger follower according to the invention.

Certain terminology is used in the following description for convenience only and is not limiting. The words "front," "rear," "upper" and "lower" designate directions in the drawings to which reference is made. The words "inwardly" and "outwardly" refer to directions toward and away from the parts referenced in the drawings. A reference to a list of items that are cited as "at least one of a, b, or c" (where a, b, and c represent the items being listed) means any single one of the items a, b, or c, or combinations thereof. The terminology includes the words specifically noted above, derivatives thereof and words of similar import.

Referring to FIG. 1, an embodiment of the switchable finger follower 10 according to the present invention is shown. The switchable finger follower 10 includes at least two lift modes and is usable in connection with a valve train 12 of an internal combustion engine, such as illustrated schematically in FIG. 7.

The valve train 12 includes a camshaft 14 with a cam 16 interacting with the switchable finger follower 10 in order to actuate a gas exchange valve 18, a stem of which is shown, in an internal combustion engine. The switchable finger follower 10 is supported via a hydraulic lash adjuster support 20 located in the head or block of an internal combustion engine. The hydraulic lash adjuster support 20 is configured to receive pressurized hydraulic fluid from a switching oil gallery 22 that is controlled via a valve 24 connected to the engine control module (ECM) 26 in order to activate or deactivate the switchable finger follower 10. The switchable finger follower 10 illustrated in connection with the preferred embodiment has a lift mode and a no lift mode. However, it could also be a switchable finger follower having a high lift mode and a low lift mode.

Figure 2:
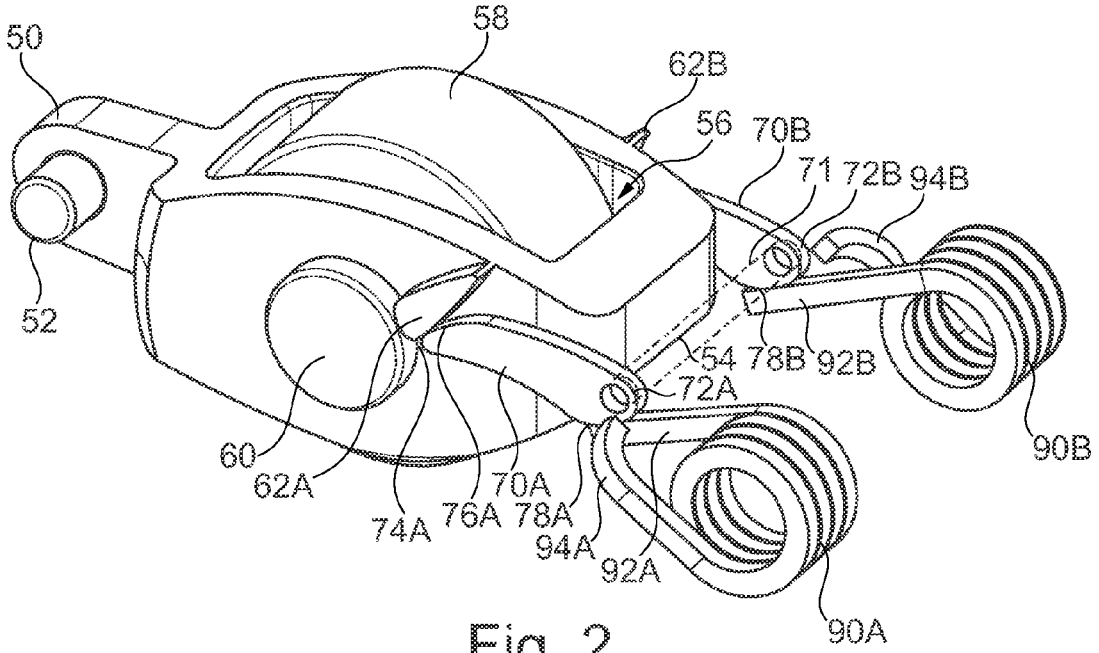
FIG. 2 is a perspective view similar to FIG. 1 in which the outer lever has been removed for clarity.
Figure 3:
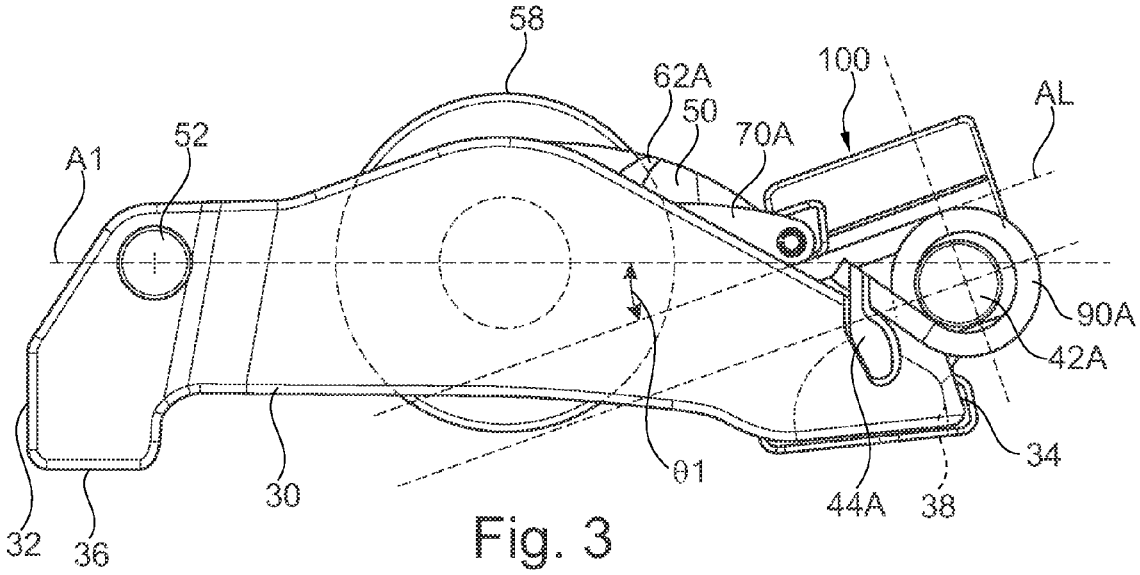
FIG. 3 is a side elevational view of the switchable finger follower FIG. 1 in a first, locked position.
Figure 4:
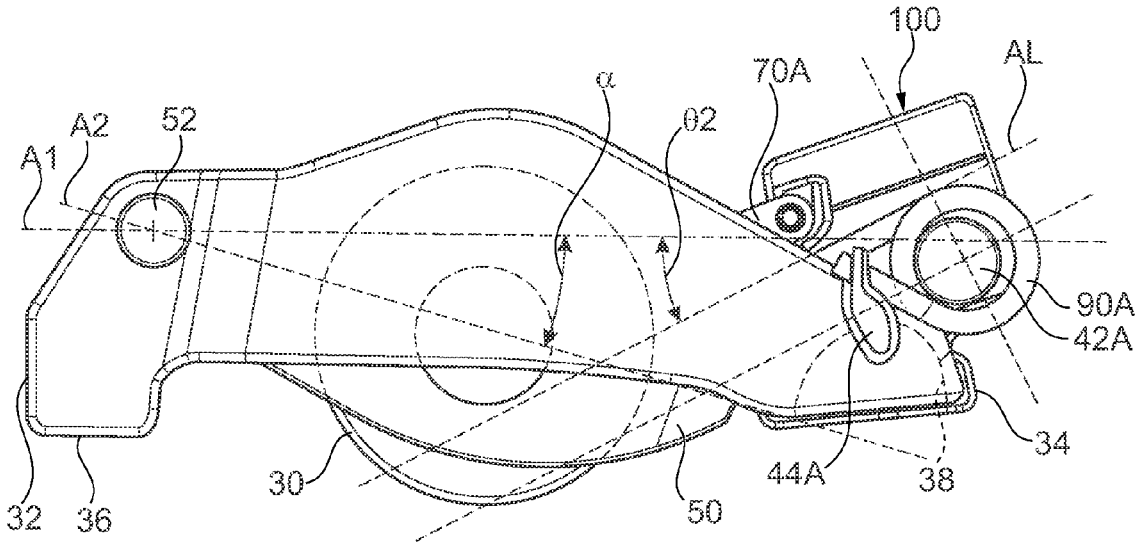
FIG. 4 is a side elevational view of the switchable finger follower as shown in FIG. 3 in the unlocked position showing a lost motion of the inner lever relative to the outer lever during a cam lift cycle in the unlocked position.
Figure 7:
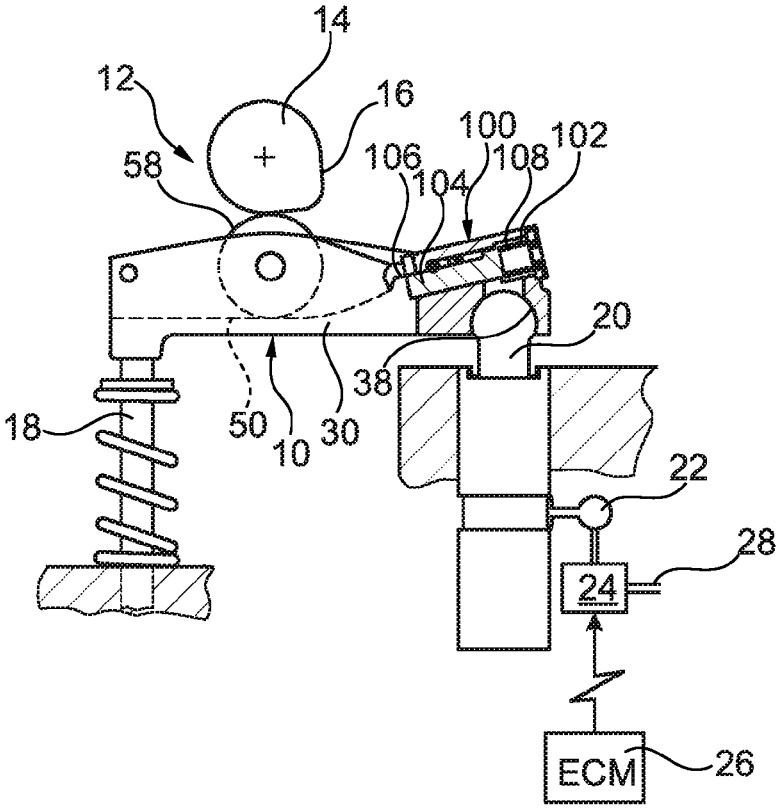
FIG. 7 is a schematic view of a valve train including the switchable finger follower according to FIG. 1.
Figure 8:
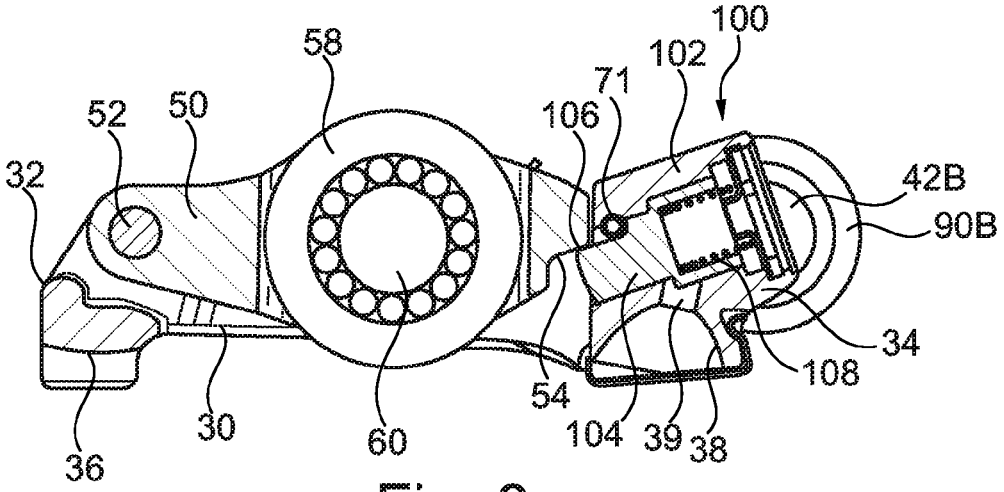
FIG. 8 is a cross-sectional view through the switchable finger follower of the FIG. 1.

Referring now to FIGS. 1 and 2, the switchable finger follower 10 is shown in detail. The switchable finger follower 10 includes a primary lever, preferably in the form of an outer lever 30 having a first end 32 and a second end 34. A valve stem support 36 is located at the first end 32 and a lash adjuster support recess (38 shown in FIGS. 3, 4, and 7) is located at the second end 34. This lash adjuster support recess 38 is preferably hemispherical in shape and is adapted to receive a head of the hydraulic lash adjuster support 20 as shown in FIG. 7. An oil passage 39, shown in detail in FIG. 8 extends to a coupling device 100, discussed in further detail below. The outer lever 30 is preferably formed with a first outer arm 40A and a second outer arm 40B that define a receiving space 46 therebetween. Each of the outer arms 40A, 40B includes a lost motion spring support post 42A, 42B located at the second end 34. Spring retaining tabs, such as 44A shown in FIGS. 1, 3, and 4 are preferably also provided on the outer arms 40A, 40B. The spring retaining tab for the second outer arm 40B is not shown but is a mirror image of the spring retaining tab 44A shown in FIG. 1.

A secondary lever preferably in the form of an inner lever 50 is mounted for pivoting movement at the first end 32 of the outer lever 30 by a pivot axle 52. The inner lever 50 includes a coupling surface 54, shown in FIG. 2, facing the second end 34, and a cam contact surface, preferably in the form of a roller 58 mounted in a slot 56 in the inner lever 50 via a transverse axle 60 and a first lost motion contact projection 62A. Preferably two lost motion contact projections 62A, 62B are provided located on opposite sides of the inner lever 50 in a mirror-symmetric manner. The first and second lost motion contact projections 62A, 62B preferably include concave surfaces that receive a lost motion spring force.

As shown in FIGS. 1 and 7, a coupling device 100 is located on the outer lever 30 and includes a coupling pin 104 located in a housing 102. The coupling pin 104 is arranged to move in a longitudinal direction between a locking position, in which the secondary, in this embodiment, inner lever 50 and the primary, outer lever 30 are locked together in a lift position at least in an activation direction of a valve, and an unlocked position, in which the secondary, inner lever 50 is pivotable relative to the primary outer lever 30. The coupling pin 104 includes a preferably flat contact surface 106 for engagement with the coupling surface 54 of the inner lever 50 in the first locking position. Preferably, an orientation of the coupling pin is maintained by the idler arm pin 71 being positioned across the coupling pin contact surface 106 to act as an anti-rotation guide.

Those skilled in the art will recognize that the secondary lever could also be the outer lever and the primary lever could be the inner lever, depending on the particular application. In each case, the primary lever provides a rigid load path between the first end 32 and second end 34 which contact the valve stem 18 and the hydraulic lash adjuster support 20, respectively, so that a cam motion either acting directly on a cam contact surface of the primary lever 30 or on a cam contact surface of a secondary lever 50 coupled to the primary lever 30 transfers a cam lift to the valve stem to open a gas exchange valve 18. In an uncoupled position of the secondary lever 50, the secondary lever 50 pivots with a lost motion relative to the primary lever 30, so that the cam motion on the secondary lever 50 does not result in the gas exchange valve 18 being opened.

A first lost motion idler arm 70A is pivotally connected to the primary, or in this embodiment, outer lever 30 at a pivot end 72A of the first lost motion idler arm 70A. The first lost motion idler arm 70A has a distal end that contacts the lost motion contact projection 62A of the inner lever. Preferably, there are first and second lost motion idler arms 70A, 70B arranged on opposite sides of the outer lever 30, each including a pivot end 72A, 72B, mounted on a idler arm pin 71, and a distal end 74A, 74B that contacts a respective one of the lost motion contact projections 62A, 62B on the inner lever 50.

A first lost motion spring 90A is located between the primary, outer lever 30 and the first lost motion idler arm 70A that maintains a preload on the inner lever 50 via the first lost motion idler arm 70A in the unlocked position. Preferably, two lost motion springs 90A, 90B are provided. The lost motion springs 90A, 90B are preferably leg springs each including a contact let 92A, 92B and a support leg 94A, 94B. The contact leg 92A, 92B of the lost motion springs engage against a spring contact surface 78A, 78B of the respective first and second lost motion idler arms 70A, 70B. The spring contact surfaces 78A, 78B preferably have a convex profile and the shape can be tailored to the particular force profile to be transmitted to the inner lever via the lost motion contact projections 62A, 62B. The support legs 94A, 94B of the lost motion springs 90A, 90B preferably engage against the respective outer arms 40A, 40B of the outer lever 30. These are retained in position via the spring retaining tabs on the outer arms 40A, 40B, with the spring retaining tab 44A being shown in FIG. 1 for the first outer arm 40A and a similar spring retaining tab being provided on the second outer arm 40B. The spring contact surfaces 78A, 78B of the respective first and second lost motion idler arms 70A, 70B are located in proximity to a pivot connection of the lost motion idler arm 70A, 70B to the outer lever 30.

Figure 5:
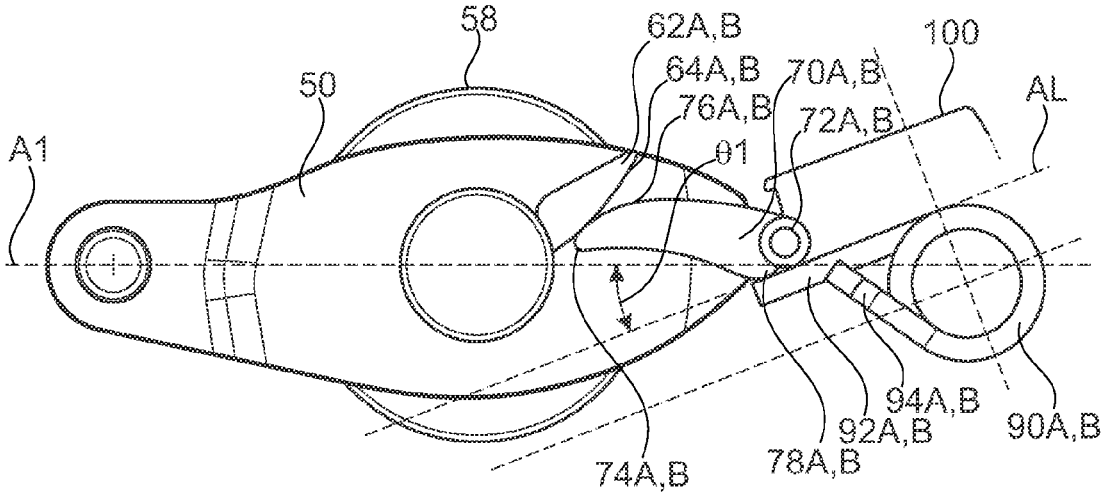
FIG. 5 is a view similar to FIG. 3 of the switchable finger follower shown without the outer lever in the first, locked position.
Figure 6:
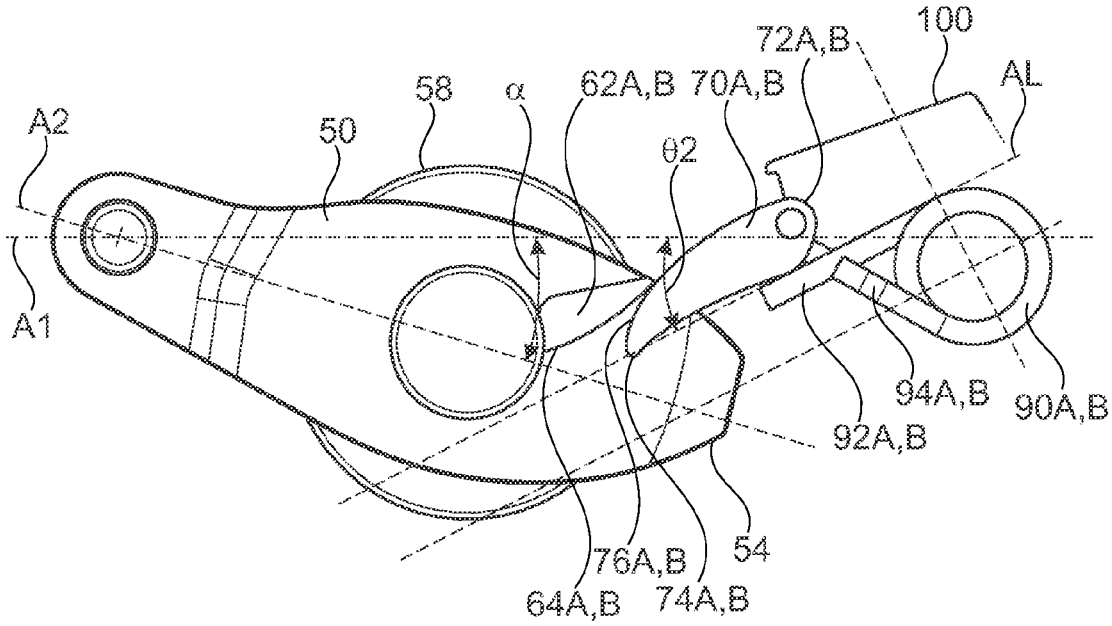
FIG. 6 is a view similar to FIG. 4 shown without the outer lever showing the inner lever in the unlocked position during a lost motion cam actuation phase.

Referring to FIGS. 3-6, FIGS. 3 and 5 are views showing the switchable finger follower 10 in the locked position in which movements transferred by the cam 16 can be transferred via the switchable finger follower 10 to the valve stem 18. In these views, the coupling pin 104 is engaged under the coupling surface 54 in the secondary, inner lever, as shown in FIG. 7. A longitudinal axis A1 is shown extending through the switchable finger follower 10 and a spring contact leg axis $A_L$ is also indicated that extends parallel to the spring contact let 92A, 92*b* for each of the lost motion springs 90A, 90B. In this position, an angle Θ1 is designated to indicate an initial position of the spring contact leg 92A, 92B in the locked position of the switchable finger follower 10. In the unlocked position in which the coupling pin 104 is withdrawn in the coupling device 100, during a cam lift phase as shown in FIGS. 4 and 6, a force of the lost motion spring 90A, 90B is transferred via the lost motion idler arm 70A, 70B to the lost motion contact projections 62A, 62B in order to absorb the lost motion movement while still maintaining sufficient force to prevent the roller from jumping off the cam as well as to prevent pump up of the hydraulic lash adjuster support 20. Here the first and second lost motion springs 90A, 90B maintain the preload on the inner lever 50 required for continued operation of the valve train without negative effects due to, for example, deactivating a cylinder and allowing the valves to remain closed during cylinder deactivation. The spring force of the first and second lost motion springs 90A, 90B is less than the force generated by the valve spring that is acted on by the switchable finger follower 10.

As can be seen from a comparison of FIGS. 3 and 5 versus FIGS. 4 and 6, an angular displacement of the contact legs 92A, 92B in an unlocked position of the coupling device 100 during a lost motion stroke is less than an angular displacement of the secondary or inner lever 50. An angle α of the lost motion stroke in the preferred arrangement is greater than 15° (approximately 15.8°) while the Δ angle between Θ1 and Θ2 which designate the angular displacement of the contact leg 92A, 92B of the lost motion springs 90A, 90B is less than 7° (approximately 6.6° in the illustrated embodiment). Here the angular displacement ratio is less than 2:1, but this can be varied based on the particular requirements for a specific application. In FIGS. 4 and 6, the longitudinal axis A2 of the inner arm is shown in order to define the angle α between the axes A1 and A2 of the outer and inner levers 30, 50, respectively. Thus, using the switchable finger follower 10 provided herein during a lost motion stroke, the lost motion spring 90A, 90B can have a lower pre-load during the locked position and, based on the lever provided via the lost motion contact arms 70A, 70B and the specific contact surface profile 78A, 78B, the force profile of the force is transferred to the inner lever 50 can be tailored to the specific requirements while allowing a shorter angular movement of the contact leg 92A, 92B of the lost motion springs 90A, 90B. The reduction in the lost motion spring angular displacement allows for a smaller space envelope as well as reduces the spring pre-load requirement due to the defined load path. The likelihood of a valve opening during deactivation is also reduced because the lost motion spring moment arm is preferably maintained approximately constant during the lost motion stroke.

As shown in FIG. 7, a valve train including the switchable finger follower 10 is also provided for activating and deactivating gas exchange valves of an internal combustion engine. Activation and deactivation of the switchable finger follower is provided via a hydraulic fluid passage, shown in FIGS. 7 and 8, that extends from the hydraulic lash adjuster support 20 via the to a pressure space in the coupling pin bore in order to move the coupling pin 104 against the force of a return spring 106 to the unlocking position. This also provides a failsafe in that if insufficient hydraulic fluid is provided, the spring 106 moves the coupling pin back to an engaged position allowing for normal operation of the finger follower 10 and the associated valve 18 in the valve train for a lift-no lift type of switchable finger follower 10 as shown. Alternatively, the coupling pin 104 can be normally biased to the open position, for example for a high lift—low lift switchable finger follower so that the fail safe position is with the coupling pin in an uncoupled position.

Preferably, at least one contact surface between the first and second lost motion idler arms 70A, 70B and the first and second lost motion contact projection 62A, 62B is coated with a friction reducing coating, such as PTFE. Other coatings may also be utilized.

While the preferred embodiment of the switchable finger follower includes the lost motion idler arms 70A, 70B connected to the primary lever 30 which is the outer lever, it is recognized that the lost motion idler arms 70A, 70B could be connected to the inner lever if the inner lever is the primary lever that provides a rigid connection that extends between the first and second ends 32, 34 from the hydraulic lash adjuster support 20 to the valve stem support 36.

While the preferred embodiment of the invention has been described in detail, those skilled in the art will recognize that other changes could be made to a switchable finger follower without departing from the scope of the present invention. Other types of coupling arrangements could be provided and the specific configuration of the inner lever and outer arms could be varied without departing from the scope of the present invention. Accordingly, the scope of the invention should not be limited by the preferred embodiments discussed above and instead should be defined by the claims as noted below.

What is claimed is:

1. A switchable finger follower having at least two lift modes for a valve train of an internal combustion engine, comprising:

a primary lever having first and second ends, with a valve stem support located at the first end and a lash adjuster support recess located at the second end;

a secondary lever mounted for pivoting movement at the first end of the primary lever by a pivot axle, the secondary lever includes: a coupling surface facing the second end, a cam contact surface, and a first lost motion contact projection;

a coupling device located on the primary lever that includes a coupling pin arranged to move in a longitudinal direction between a locking position, in which the secondary lever is locked to the primary lever in a lift position at least in an activation direction of a valve, and an unlocked position, in which the secondary lever is pivotable relative to the primary lever, the coupling pin including a contact surface for engagement with the coupling surface of the secondary lever in the locking position;

a first lost motion idler arm pivotally connected to the primary lever at a pivot end of the first lost motion idler arm and having a distal end that contacts the lost motion contact projection on the secondary lever; and a first lost motion spring located between the primary lever and the first lost motion idler arm that maintains a preload on the secondary lever via the first lost motion idler arm in the unlocked position.

2. The switchable finger follower of claim 1, wherein the primary lever is an outer lever, and the outer lever includes a receiving space therein, and the secondary lever is an inner lever, with the inner lever being pivotably located in the receiving space.

3. The switchable finger follower of claim 2, wherein the secondary lever comprises two secondary arms with the receiving space defined therebetween.

4. The switchable finger follower of claim 1, wherein the first lost motion spring is formed as a leg spring having a first leg that contacts the first lost motion idler arm and a second leg that is engaged on a portion of the primary lever.

5. The switchable finger follower of claim 1, wherein an angular displacement of the first leg in an unlocked position of the coupling device during a lost motion stroke is less than an angular displacement of the secondary lever.

6. The switchable finger follower of claim 1, wherein the first lost motion contact projection has a curved contact face that contacts the first lost motion idler arm.

7. The switchable finger follower of claim 1, wherein a spring contact surface of the first lost motion idler arm is located in proximity to a pivot connection to the primary lever.

8. The switchable finger follower of claim 1, wherein the spring contact surface of the first lost motion idler arm has a convex profile.

9. The switchable finger follower of claim 1, further comprising a second lost motion projection on the secondary lever, a second lost motion idler arm pivotally mounted to the primary lever and a second lost motion spring, the second lost motion spring maintains an additional preload on the secondary lever via the second lost motion idler arm in the unlocked position.

10. The switchable finger follower of claim 9, wherein a spring force of the first and second lost motion springs is less than a force generated by a valve spring acted on by the finger follower.

11. The switchable finger follower of claim 10, wherein the coupling device comprises a coupling housing located on the primary lever with a coupling pin bore in which the coupling pin is located.

12. The switchable finger follower of claim 11, wherein a hydraulic fluid passage is located in the primary lever and extends to a pressure space in the coupling pin bore, and pressurized hydraulic fluid provided to the pressure space moves the coupling pin to the unlocking position.

13. The switchable finger follower of claim 11, wherein the coupling pin includes a flat contact surface that engages a coupling surface on the secondary lever, and the first lost motion idler arm is connected to the primary lever by an idler mounting pin that faces the flat contact surface as an anti-rotation guide.

14. The switchable finger follower of claim 1, wherein at least one contact surface between the first lost motion idler arm and the first lost motion contact projection is coated with a friction reducing coating.

15. A valve train comprising:

a switchable finger follower having a primary lever having first and second ends, with a valve stem support located at the first end and a lash adjuster support recess located at the second end, a secondary lever mounted for pivoting movement at the first end of the primary lever by a pivot axle, the secondary lever includes: a coupling surface facing the second end, a cam contact surface, and a first lost motion contact projection, a coupling device located on the primary lever that includes a coupling pin arranged to move in a longitudinal direction between a locking position, in which the secondary lever is locked to the primary lever in a lift position at least in an activation direction of a valve, and an unlocked position, in which the secondary lever is pivotable relative to the primary lever, the coupling pin including a contact surface for engagement with the coupling surface of the secondary lever in the locking position, a first lost motion idler arm pivotally connected to the primary lever at a pivot end of the first lost motion idler arm and having a distal end that contacts the lost motion contact projection on the secondary lever, and a first lost motion spring located between the primary lever and the first lost motion idler arm that maintains a preload on the secondary lever via the first lost motion idler arm in the unlocked position;

a camshaft having a cam that contacts the cam contact surface;

a gas exchange valve having a valve stem that is acted on by the first end of the primary lever;

a lash adjuster support that supports the second end of the primary lever, the lash adjusting support being in communication with a switching hydraulic fluid gallery for delivering pressurized hydraulic fluid to the coupling device in order to shift the coupling pin between the locking position and the unlocked position.

16. The valve train of claim 15, wherein the primary lever is an outer lever, and the outer lever includes a receiving space therein, and the secondary lever is an inner lever, with the inner lever being pivotably located in the receiving space.

17. The valve train of claim 15, further comprising a second lost motion projection on the secondary lever, a second lost motion idler arm pivotally mounted to the primary lever and a second lost motion spring, the second lost motion spring maintains an additional preload on the secondary lever via the second lost motion idler arm in the unlocked position.

* * * * *